US006386327B2

(12) United States Patent
Lacarte Estallo

(10) Patent No.: US 6,386,327 B2
(45) Date of Patent: May 14, 2002

(54) EQUIPMENT FOR GENERATION OF SHAFT INFORMATION OF AN ELEVATOR INSTALLATION

(75) Inventor: José Luis Lacarte Estallo, Zaragoza (ES)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 09/377,195

(22) Filed: Aug. 19, 1999

(30) Foreign Application Priority Data

Aug. 21, 1998 (EP) ..... 98810822

(51) Int. Cl.[7] ..... B66B 3/02
(52) U.S. Cl. ..... 187/394
(58) Field of Search ..... 187/391, 393, 187/394; 49/13, 14, 26, 27, 28

(56) References Cited

U.S. PATENT DOCUMENTS 2,598,214 A * 5/1952 Borden ..... 187/291
4,134,476 A * 1/1979 Zolnerovich et al. ..... 187/29 R
4,674,603 A * 6/1987 Estrella ..... 187/28
5,509,505 A * 4/1996 Steger et al. ..... 187/394
5,594,219 A * 1/1997 Kamani et al. ..... 187/394
5,613,576 A * 3/1997 Lamb ..... 187/355
5,655,627 A * 8/1997 Horne et al. ..... 187/335
5,659,159 A * 8/1997 Koopman ..... 187/291
5,682,024 A * 10/1997 Koopman et al. ..... 187/394
5,831,227 A * 11/1998 Finn et al. ..... 187/394

FOREIGN PATENT DOCUMENTS

GB 2166711 * 5/1986 ..... 187/394
JP 354146364 * 11/1979 ..... 187/394
JP 404191274 * 7/1992 ..... 187/394
JP 406156910 * 6/1994 ..... 187/391

* cited by examiner

*Primary Examiner*—Jonathan Salata
(74) *Attorney, Agent, or Firm*—Cohen, Pontani, Lieberman & Pavane

(57) ABSTRACT

Equipment for generation of shaft information, including transmitter elements of a elevator shaft arranged at the back part of a frame of a story door. Opposite the transmitter elements switchable transmitters are arranged at the back part of a frame of a cage door. Mounting time and costs are substantially reduced by the arrangement of the transmitter elements and transmitters at existing components.

10 Claims, 3 Drawing Sheets

EQUIPMENT FOR GENERATION OF SHAFT INFORMATION OF AN ELEVATOR INSTALLATION

BACKGROUND OF THE INVENTION

1. Field of the Invention

The invention relates to equipment for generation of shaft information of an elevator installation, consisting of an elevator shaft with at least one storey door and an elevator cage, which is movable in the elevator shaft, with a cage door. At least one transmitter element is arranged in the elevator shaft and changes the switching state of at least one transmitter, which is arranged at the elevator cage, during travel of the elevator cage in the elevator shaft.

2. Discussion of the Prior Art

Magnets arranged in the elevator shaft serve, together with magnet switches arranged at the elevator cage, for the generation of shaft information. During travel of the elevator cage in the elevator shaft the magnet switches the magnet switch, which is usually constructed as a bistable switch, from one switching state into the other switching state, wherein the instantaneous position of the elevator cage in the elevator shaft is determined for the elevator control by the position of the relevant magnets. The magnets arranged, for example, in the region of stories or floors are usually arranged on rails with grooves, into which groove blocks are laid. The magnets are screw-connected to the groove blocks of the rails by means of screws, wherein the magnets are displaceable along the rails in the loosened state of the screws.

A disadvantage of the known equipment resides in that an expensive mounting device for the magnets is necessary in the region of each story, which causes substantial costs and mounting time.

SUMMARY OF THE INVENTION

Accordingly, it is an object of the present invention to provide equipment for generating shaft information of an elevator installation in which expensive mounting is not required. Pursuant to this object, and others which will become apparent hereafter, one aspect of the present invention resides in the equipment including at least one transmitter element arranged at a door element of the story door, and at least one transmitter arranged at a door element of the cage door so that the transmitter element changes the switching state of the transmitter during travel of the elevator in the elevator shaft. The invention, thus meets the object of avoiding the disadvantages of the known equipment and of bringing about a simplification of the mounting of the transmitter elements and of the transmitters for generation of shaft information.

The advantages achieved by the invention are essentially to be seen in that the means for mounting the transmitter elements are cheap in manufacture and simple for mounting. The mounting time is substantially shortened and the costs for the shaft information equipment significantly reduced relative to conventional systems.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
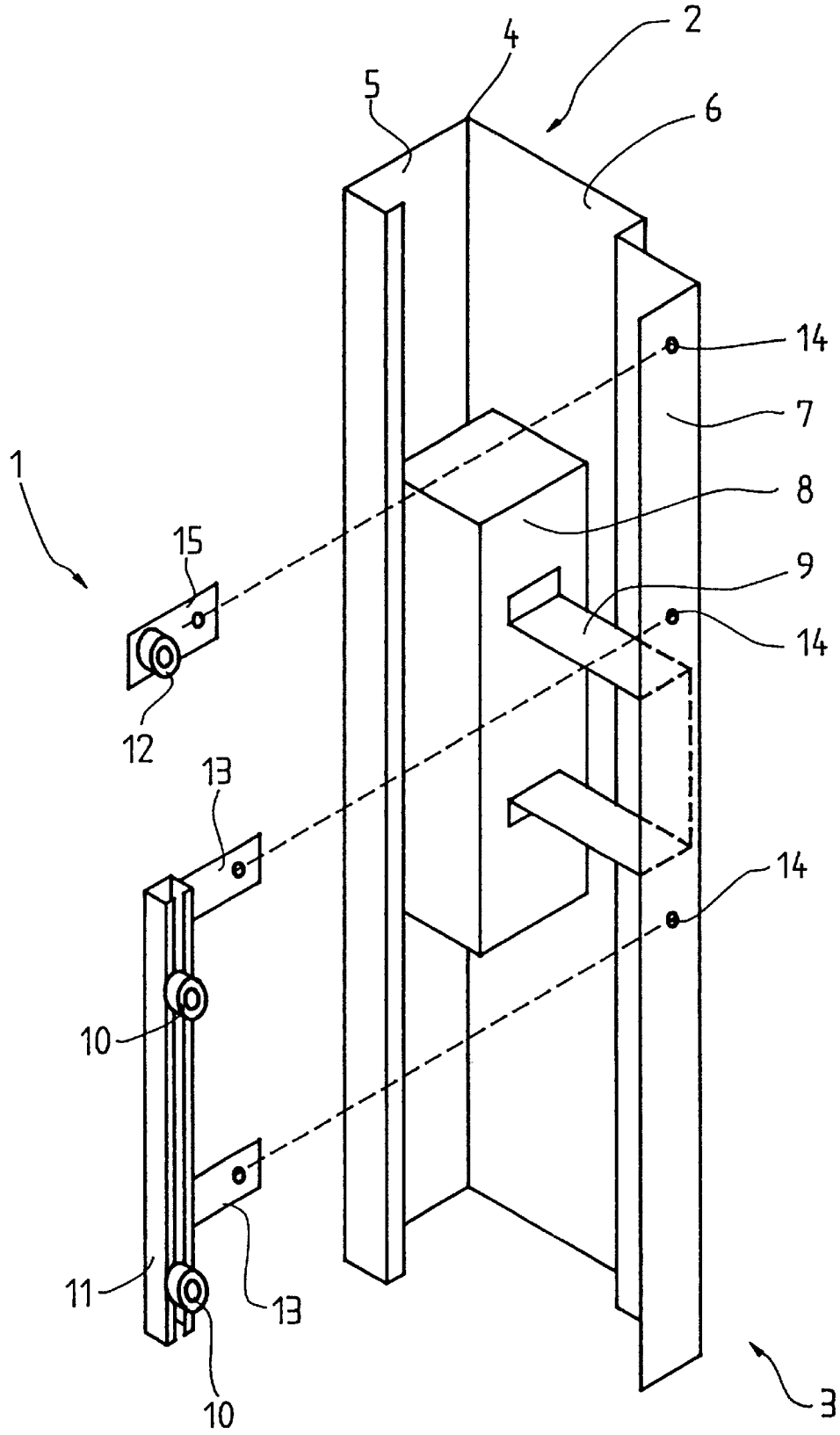
FIG. 1 shows a frame of a story door with transmitter elements for generation of shaft information.
Figure 2:
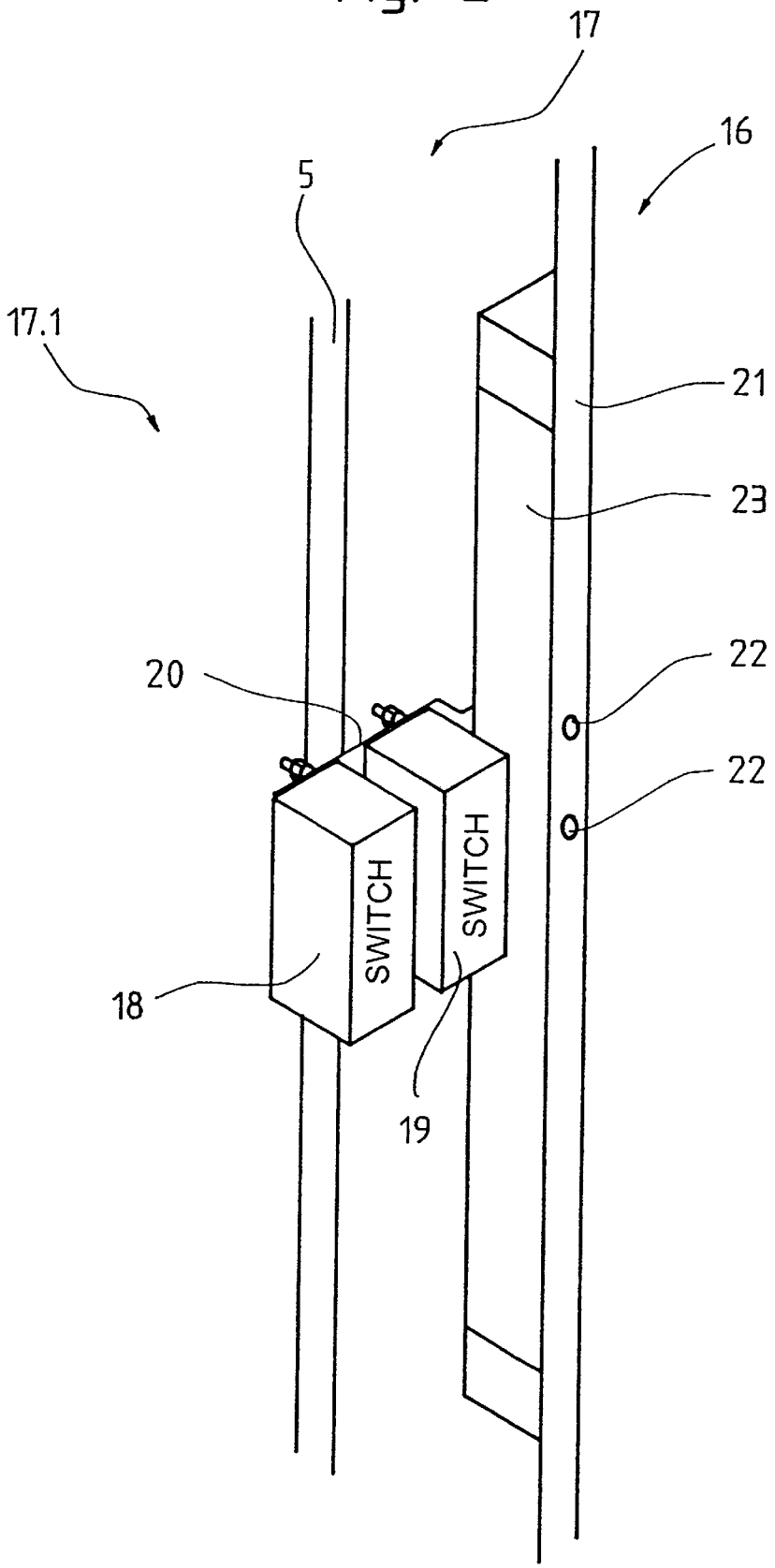
FIG. 2 shows a frame of an elevator cage door with transmitters for generation of shaft information.
Figure 3:
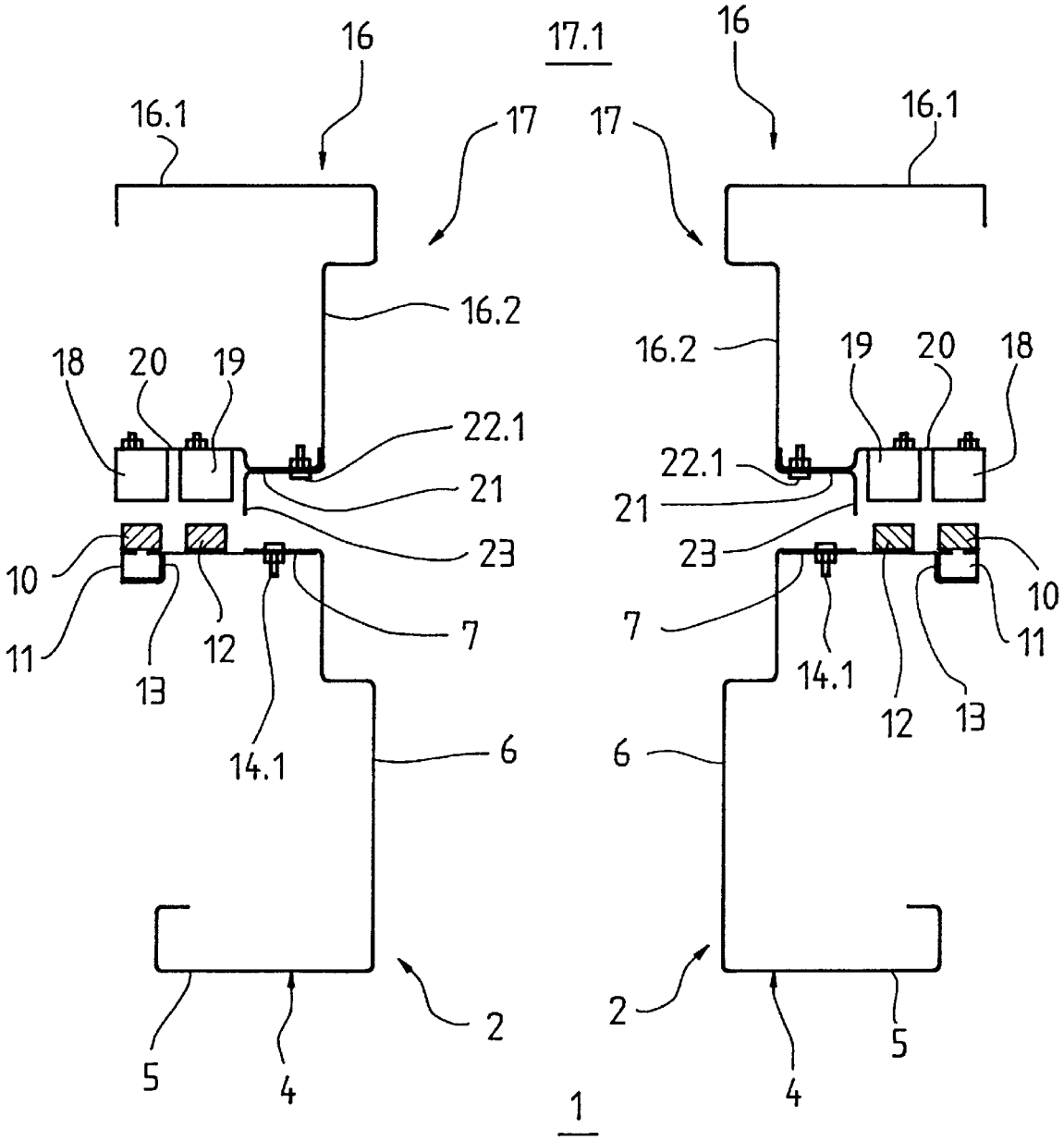
FIG. 3 shows a horizontal section through the frames.

A story of an elevator installation is denoted by 1 in FIGS. 1 to 3. A story door 2 closes off the story 1 relative to an elevator shaft 3. The story door 2 comprises door leaves, which are not shown, and a door element which is constructed as, for example, a first frame 4 and which is connected with the building structure. The first frame 4 consists of a first front part 5, a first side part 6 and of a first back part 7. Arranged at the front part 5 is a housing 8 with story buttons and/or indicator elements, which housing is secured to the first back part 7 by means of a bracket 9. The elements, for example anchors and/or straps, for fastening the first frame 4 to the building structure are not illustrated.

Serving for generation of shaft information are magnets 10, 12, which are arranged at a determined shaft height and which effect the switching over of a travel speed to a crawling speed or the switching-off of the drive. First magnets 10, which serve for the exact detection of the story height, are arranged on, for example, a C-section profile member serving as a carrier 11. The first magnets 10 are displaceable along the carrier 11 and are secured, by means of screws, to groove blocks in the C-section profile member. The carrier 11 is arranged at the first back part 7 of the first frame 4 by means of mounts 13, wherein the mounts 13 are secured, for example, at preformed first bores 14 of the first back part 7 by means of first screws 14.1. The second magnet 12 is arranged at a first bracket 15, which is arranged, for example, in the upper or lower door region at the first back part 7.

FIGS. 2 and 3 show a cage door 17, which comprises not-illustrated door leaves and a door element constructed as, for example, a second frame 16 and connected with the building structure. The elements for fastening the second frame 16 to the building structure are not illustrated. Magnet switches/transmitters 18, 19 are arranged at the second frame 16, which consists of a second front part 16.1, a second side part 16.2 and of a second back part 21, of the cage door 17 of an elevator cage 17.1. The magnet switches 18, 19 are arranged at the second back part 21 of the second frame 16 by means of a second bracket 20. The second bracket 20 is secured at, for example, preformed second bores 22 of the second back part 21 by means of second screws 22.1. The first magnet switch 18 is actuated by means of the first magnets 10 and the second magnet switch 19 is actuated by means of the second magnets 12. A magnetic screen 23 is provided at the vicinity of the back part to ensure switching reliability of the magnet switches 18, 19.

FIG. 3 shows a horizontal section through the frames 4 and 16, wherein a door abutting at the left and abutting at the right is illustrated.

Instead of the magnets 10, 12 and the magnet switches 18, 19, transmitter elements and transmitters operating on a different principle of functioning, for example inductively, can be provided.

According to the respective disposition of the elevator installation the magnets 10, 12 or the magnet switches 18, 19 can also be arranged at other components of the elevator shaft 3 or the elevator cage 17.1

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

I claim:

1. Equipment for generation of shaft information of an elevator installation including an elevator shaft with at least one story door and an elevator cage which is movable in the elevator shaft and has a cage door, the equipment comprising:

a door frame forming part of the story door;

a door element forming part of the cage door;

at least one transmitter arrangeable at the elevator cage;

at least one transmitter element arrangeable in the elevator shaft so as to change a switching state of the at least one transmitter during travel of the elevator cage in the elevator shaft, the transmitter element being mounted directly to the door frame of the story door and the transmitter being arranged at the door element of the cage door.

2. The equipment for generation of shaft information according to claim 1, wherein the door frame has a first back part at which the transmitter element is arranged, and the door element of the cage door is a second frame with a second back part at which the transmitter is arranged so that the transmitter element is adjacent the transmitter.

3. The equipment for generation of shaft information according to claim 2, and further comprising a carrier connected with the first back part, and mounts that connect the carrier to the first back part, the transmitter element being displaceably arranged at the carrier.

4. The equipment for generation of shaft information according to claim 2, and further comprising a first bracket connected with the first back part, the transmitter element being connected to the first bracket.

5. The equipment for generation of shaft information according to claim 2, and further comprising a second bracket connected with the second back part, the transmitter being connected to the second bracket.

6. The equipment for generation of shaft information according to claim 5, and further comprising a magnetic screen arranged between the transmitter and the second back part.

7. Equipment for generation of shaft information of an elevator installation including an elevator shaft with at least one story door and an elevator cage which is movable in the elevator shaft and has a cage door, the equipment comprising:

a door frame forming part of the story door, the door frame having a vertical member;

a door element forming part of the cage door;

at least one transmitter arranged at the elevator cage; and at least one transmitter element mounted directly to the vertical member of the door frame of the story door so as to change a switching state of the transmitter during travel of the elevator cage in the elevator shaft.

8. The equipment for shaft information according to claim 7, wherein the door frame has a first back part at which the transmitter element is arranged.

9. Equipment for generation of shaft information of an elevator installation including an elevator shaft with at least one story door and an elevator cage which is movable in the elevator shaft and has a cage door, the equipment comprising:

a door frame forming part of the story door;

a door element forming part of the cage door;

at least one transmitter arranged at the door element of the cage door; and at least one transmitter element mounted directly to the door frame so as to change a switching state of the at least one transmitter during travel of the elevator cage in the elevator shaft.

10. The equipment for generation of shaft information according to claim 9, wherein the door element of the cage door is a second frame with a second back part at which the transmitter is arranged.

* * * * *